US005523196A

United States Patent [19]

Iwashita et al.

[11] Patent Number: 5,523,196

[45] Date of Patent: Jun. 4, 1996

[54] METHOD FOR REPLENISHING A DEVELOPER

[75] Inventors: Mariko Iwashita; Takeshi Sampei, both of Hino, Japan

[73] Assignee: Konica Corporation, Japan

[21] Appl. No.: 322,708

[22] Filed: Oct. 13, 1994

[30] Foreign Application Priority Data

Oct. 14, 1993 [JP] Japan ..... 5-257251

[51] Int. Cl.[6] ..... G03C 5/18; G03C 5/26; G03C 1/00; G03C 1/06

[52] U.S. Cl. ..... 430/399; 430/445; 430/446; 430/269; 430/598; 430/488; 430/489

[58] Field of Search ..... 430/399, 445, 430/446, 264, 598, 488, 489

[56] References Cited

U.S. PATENT DOCUMENTS

| | | | |
|---|---|---|---|
| Re. 26,601 | 6/1969 | Allen et al. | 430/489 |
| 2,952,539 | 9/1960 | Dersch et al. | 430/446 |
| 2,956,876 | 10/1960 | Spath | 430/489 |
| 3,161,515 | 12/1964 | Welsh | 430/446 |
| 3,647,461 | 3/1972 | Surash et al. | 430/399 |
| 3,647,462 | 3/1972 | Surash et al. | 430/399 |
| 4,025,344 | 5/1977 | Allen et al. | 430/399 |
| 4,081,280 | 3/1978 | Corluy et al. | 430/399 |
| 4,740,452 | 4/1988 | Okutsu et al. | 430/445 |
| 4,786,584 | 11/1988 | Endo | 430/399 |
| 4,828,968 | 5/1989 | Okutsu | 430/399 |
| 4,977,067 | 12/1990 | Yoshikawa et al. | 430/399 |
| 5,063,141 | 11/1991 | Nakamura | 430/399 |
| 5,124,239 | 6/1992 | Fujita et al. | 430/399 |
| 5,206,121 | 4/1993 | Fujita et al. | 430/399 |
| 5,252,439 | 10/1993 | Nakamura | 430/399 |
| 5,288,590 | 2/1994 | Kuwabara et al. | 430/598 |
| 5,352,563 | 10/1994 | Kawasaki et al. | 430/598 |

FOREIGN PATENT DOCUMENTS

| | | | |
|---|---|---|---|
| 589332 | 12/1959 | Canada | 430/489 |
| 0219010 | 4/1987 | European Pat. Off. | 430/264 |
| 2508137 | 9/1975 | Germany | 430/264 |
| 6-59405 | 3/1994 | Japan | 430/488 |
| 374572 | 11/1973 | U.S.S.R. | 430/445 |

OTHER PUBLICATIONS

*Research Disclosure*, Jul. 1979, p. 392, anonymous.

*Primary Examiner*—Charles L. Bowers, Jr.
*Assistant Examiner*—J. Pasterczyk
*Attorney, Agent, or Firm*—Jordan B. Bierman; Bierman and Muserlian

[57] ABSTRACT

Disclosed is a method for developing a silver halide photographic light-sensitive material with a developer having a pH within the range of 9.5 to 10.7 through an automatic processor, wherein said silver halide photographic light-sensitive material comprises a support and thereon, at least one silver halide emulsion layer comprising silver halide grains containing at least 60 mol % of silver chloride, comprising the steps of:

replenishing a first developer replenishing-solution having lower activity than a starter for a developer; and replenishing a second developer replenishing-solution having the substantially same activity as said starter for a developer.

19 Claims, No Drawings

METHOD FOR REPLENISHING A DEVELOPER

FIELD OF THE INVENTION

This invention relates to a method for replenishing a developer in a rapid process and, particularly to a method for replenishing a developer in a substantially smaller amount.

BACKGROUND OF THE INVENTION

A photographic plate-making process applicable with a silver halide photographic light-sensitive material include, for example, a step for converting a continuous tone original into a halftone-dot image, that is a step for converting the density variation of a continuous tone into an aggregate of the halftone dots having an area proportionate to the above-mentioned density; a step for converting the halftone dot image obtained in the above-mentioned step into an halftone dot image having an image sharpness more excellent than the above-mentioned halftone dot image, that is, a contact step; and so forth.

A light-sensitive material applicable to the above-mentioned steps has been regarded so far to be inevitable to have a high contrast, because an excellent halftone dot image is required to come out.

As for the methods for obtaining the above-mentioned characteristics, there has so far been such a known method as the so-called lith development method, in which a light-sensitive material comprising a silver chlorobromide emulsion comprised of comparatively fine-grains (having a grain size of the order of 0.2μ) having a narrow grain size distribution and a high silver chloride content (at least not less than 50 mol %), such light-sensitive material is processed with an alkali hydroquinone developer having a very low sulfurous acid ion concentration.

However, when making use of the above-mentioned method, there is such a problem that preservability is seriously deteriorated because the sulfurous acid ion concentration is low in a developer, and that a development speed is too slow to perform any rapid processing.

It has accordingly been demanded for developing a novel light-sensitive material from which a high contrast can be obtained by processing it with a developer containing a super-additivity type developing agent having an excellent preservability and a rapid processing performance and also containing a sulfite having a comparatively higher concentration, that is so-called a PQ type developer (containing a developing agent comprising a 3-pyrazolidone compound and dihydroxybenzene) or an MQ type developer (containing a developing agent comprising an aminophenol compound and dihydroxybenzene).

As for the above-mentioned light-sensitive materials, Japanese Patent Examined Publication (hereinafter referred to as JP Ex. Publication) Nos. 59-17825/1984 and 59-17826/1984 disclose each a silver halide photographic light-sensitive material containing a tetrazolium compound, and Japanese Patent Publication Open to Public Inspection (hereinafter referred to as JP OPI Publication) No. 56-106244/1981 discloses a silver halide photographic light-sensitive material containing a hydrazine compound.

In the above-mentioned techniques, a light-sensitive material has to be processed with a developer having a pH of not lower than 11.2 so that the hard contrast property of a hydrazine derivative can satisfactorily be displayed. When a developer having a high pH of not lower than 11.2 is exposed to the air, the subject developing agent is liable to be oxidized. For remedying the defect, JP OPI Publication No. 63-29751/1988 and European Patent Nos. 333,435 and 345,025 disclose each a method for processing a silver halide photographic light-sensitive material containing a contrast hardener capable of providing a hard contrast even when making use of a developer having a comparatively lower pH, wherein the above-mentioned light-sensitive material is processed with a developer not containing substantially any alkanolamine compound.

In recent years, a demand for many photographic processing have increased. However, when a developing solution contacts with air, a developing agent of the developing solution is oxidized, and then, the activity of the developing solution is raised, so that the variation of photographic performance is caused. Therefore, to prevent the variation, many developer replenishing solution has been employed as conventional method.

However, in recent years, a rapid processability and a lower replenishment have further been demanded, so that the above-mentioned conventional method is not capable of meeting demands of the rapid processability and the lower replenishment.

For satisfying the demands for a rapid processability and a lower replenishment, a light-sensitive material has increasingly been applied with such an emulsion that a development and a fixation can be performed within a short time and silver chloride capable of excellently performing a rapid processing is contained therein. However, a silver chloride emulsion has such a defect that a sensitivity and a contrast are liable to be varied during the aging and running a developer used and that a fog is also liable to produce. Therefore, it is problematic that a lower replenishment may not be performed.

SUMMARY OF THE INVENTION

For solving the above-mentioned problems, it is an object of the invention to provide a method for replenishing a developer, in which a lower replenishment can be performed in a rapid processing without suffering any photographic characteristics, and the photographic characteristics and the stability of the developer can be kept excellent.

The above-mentioned object of the invention can be achieved in the following method; in a method for developing a silver halide photographic light-sensitive material comprising a support bearing thereon at least one silver halide emulsion layer comprising silver halide grains containing at least 60 mol % of silver chloride in the silver halide emulsion thereof, the silver halide light-sensitive material is developed by making use of a developer having a pH within the range of 9.5 to 10.7 through an automatic processor; a method for replenishing a developer characterized in that a starter for a developer and a developer replenishing-solution have each the different activities. The preferable embodiments of the invention include, for example, a method of replenishing a developer in such a manner that a first replenisher, that has an activity lower than that of a developer to be used when starting a development, is replenished in a predetermined amount per a specific unit time, and the second replenisher, that has an activity substantially equivalent to that of the developer to be used when starting the development, is replenished in the case where a replenishment is made in an amount exceeding the predetermined amount. The expression, "an activity substantially equivalent to - - - ", herein means that the deviation of an activity is to be within the range of ±5%. It is also preferable to contain a hydrazine derivative or a tetrazolium compound in the above-mentioned silver halide emulsion layer and/or the layer adjacent thereto, and it is further preferable to contain a non-benzo condensed ring type nitrogen-containing heterocyclic compound having a mercapto group or a thione group as a substituent in the above-mentioned developer. In the present invention, a starter for a developer is defined to be a developing solution immediately after prepared.

When the method for replenishing a developer of the present invention, is employed, the activity of a developer solution being accelerated with air oxidation, is returned to an appropriate activity in starting of developing, so that an amount of developer replenishing solution can be minimized compared with the replenishing amount used excessively in conventional replenishing method. Accordingly, no-variation of photographic performance and a lower replenishment on one hand and cruise efficiency on the other, disclosed in the present invention, can be obtained.

Now, the invention will more concretely be detailed.

A dihydroxybenzene developing agent applicable to a developer of the invention include, for example, hydroquinone, chlorohydroquinone and methyl hydroquinone. Among them, hydroquinone is preferably used.

The examples of a 3-pyrazolidone developing agent include 1-phenyl-3-pyrazolidone, 1-phenyl-4,4-dimethyl-3-pyrazolidone, 1-phenyl-4-methyl-4-hydroxymethyl-3-pyrazolidone, 1-phenyl- 4,4-dihydroxymethyl-3-pyrazolidone, 1-phenyl-5-methyl-3-pyrazolidone, 1-p-aminophenyl-4,4-dimethyl-3-pyrazolidone, 1-p-tolyl- 4,4-dimethyl-3-pyrazolidone, and 1-p-tolyl-4-methyl-4-hydroxymethyl- 3-pyrazolidone.

An aminophenol type developing agent include, for example, N-methyl-p-aminophenol, p-aminophenol, N-(β-hydroxyethyl)-p-aminophenol, N-(4-hydroxyphenyl)glycine, 2 -methyl-p-aminophenol, and p-benzylaminophenol. Among them, N-methyl-p-aminophenol is preferably used.

It is preferable to use a dihydroxybenzene type developing agent usually in an amount within the range of 0.05 mols/liter to 2 mols/liter. When making combination use of a dihydroxybenzene and a 3-pyrazolidone or an aminophenol, it is preferable to use the former in an amount within the range of 0.01 mols/liter to 1.5 mols/liter and the latter in an amount of not more than 0.2 mols/liter.

A sulfite preservative applicable to the invention includes, for example, sodium sulfite, potassium sulfite, lithium sulfite, sodium bisulfite, potassium metabisulfite and sodium aldehyde bisulfite. A sulfite is used in an amount of not less than 0.3 mols/liter. However, when it is added too much, it precipitates in a developer so as to contaminate the developer. It is therefore preferable to add it in an amount of 1.2 mols/liter as the upper limit.

In the invention, it is characterized to contain substantially none of such an alkanol amine compound as given in JP OPI Publication Nos. 56-106244/1981, 61-267759/1986, 61- 230145/1986, 62-211647/1987, 2-50150/1990 and 2-208652/1990, (including, for example, N-n-butyl diethanoi amine, 3-diethylamino-1,2-propane diol, 1-diethylamino-1-ethanol, 2 -diethylamino-1-butanol, 3-diethylamino-1-propanol and N,N-di-n-butylethanol amine). The expression, "to contain substantially none of - - - ", herein means an amount of not more than 0.01 mols/liter.

To a developer applicable to the invention, it is also allowed to contain a glycol such as diethylene glycol and triethylene glycol so as to serve as an organic solvent.

In the invention, a pH value of a developer to be applied is within the range of 9.5 to 10.7. When the pH thereof is within the range of 9.5 to 10.7, hard contrast image can be obtained and further, an increment of fog is restrained. The preferable pH value thereof is to be within the range of 10.0 to 10.5.

In the invention, the first replenisher is diluted with water to make a solution having a pH lower, containing a development inhibitor more and having a content of a developing agent smaller, than in a starter for a developer.

When a first replenishing-solution comprises a starter for a developer, and water, the starter for the developer and water are replenished independently or at the same time in a replenishing step of a first replenishing solution.

The activity of a developer can be represented by a sensitivity obtained after a photographic processing. The activity of a developer can be varied by changing the amount or kinds of the compositions of the developer. For example, when changing the amount or kind of a developing agent, a pH, a development inhibitor and/or a development accelerator, or the dilution of a developer, the activity of a developer can be varied. As for the methods for lowering the activity of a developer, there are various methods including, preferably, a method of reducing a developing agent, another method of lowering the pH of a developer, a further method of increasing a development inhibitor and a still further method of diluting a developer with water. In the method of reducing a developing agent, it is preferable that the amount of the developing agent of a developer replenisher is to be within the range of 70% to 98% of the amount of the developing agent of a starter for a developer. In the method of lowering the pH of a developer, it is preferable that the pH of a developer replenishing-solution is to be within the range of 0.1 to 0.5 lower than the pH of a starter for a developer. In the method of increasing a development inhibitor, it is preferable that the amount of an inorganic development inhibitor such as potassium bromide contained in a developer replenishing-solution or the amount of an organic development inhibitor such as 5-methyl benzotriazole, 5-methyl benzimidazole, 5-nitroindazole, adenine, guanine and 1-phenyl-5-mercaptotetrazole is to be within the range of 102% to 180% more than that of a development inhibitor of a starter for a developer. In the method of diluting a developer with water, it is preferable that a developer replenishing-solution is diluted with water in an amount within the range of 2% to 80% more than the amount of a starter for a developer. Among the above-mentioned methods of lowering the activity of a developer, the method of diluting a developer with water is preferable from the viewpoint of the handling conveniences. Further in recent years, from the viewpoint of the transportability, there has very often used such a method that a developer is supplied in the form of a condensed liquid and the conc. liquid is diluted with water in an amount within the range of 0.3 to 4 times as much as the conc. liquid, when it is used. Accordingly, in the method of diluting a developer with water for lowering the activity of a developer when preparing a developer replenisher of a conc. developer, it is preferable that it is diluted with water in an amount more than in the case of preparing a starter for a developer of a conc. developer and, it is more preferable that it is diluted with water in an amount within the range of 2 to 80% more than in the case of preparing a starter for a developer of a conc. developer.

The activity of the developer replenishing solution of the present invention, is less than 95% of the activity of a starter for developer. Further, the activity of the developer replenishing solution is within the range of 50% to 90% of the activity of a starter for a developer.

The replenishing period of the developer replenishing solution of the present invention, can be carried out immediately before a starting of developing or during photographic processing. Further, it is preferable to be carried out immediately before a starting of developing.

It is preferable that an amount of a developer replenishing-solution is to be within the range of 75 to 200 ml/m$^2$, and that a processing time is to be within the range of 20 to 60 seconds in terms of Dry to Dry.

Now, a preferably applicable nonbenzo-condensed ring nitrogen-containing heterocyclic compound having a mercapto or thione group, as a substituent, will be detailed.

A nitrogen-containing heterocyclic compound is a heterocyclic compound that contains nitrogen having a 3- to 10-membered nonbenzo condensed ring and that is also substituted with at least one mercapto or thione group and, preferably, a compound represented by the following formula [I].

Formula [I]

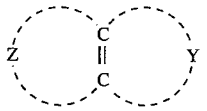

wherein Z and Y represent each a ring capable of forming an unsaturated 5- or 6-membered ring, (such as pyrrole, imidazole, pyrazole, pyrimidine and pyridamine), provided that three or more nitrogen atoms are contained in Z and Y in all, that Z and Y are each substituted with at least one mercapto group and may be substituted with the other substituent than a mercapto group, including, for example, a halogen atom (such as fluorine, chlorine and bromine), a lower alkyl group (including those having a substituent and, preferably, those having not more than 5 carbon atoms such as a methyl group and an ethyl group), a lower alkoxy group (including those having a substituent and, preferably, those having not more than 5 carbon atoms such as methoxy, ethoxy and butoxy), a hydroxy group, a sulfo group, a lower allyl group (including those having a substituent and, preferably, those having not more than 5 carbon atoms), an amino group, a COOM group (in which M represents a hydrogen atom, an alkali-metal atom or an ammonium group), a carbamoyl group and a phenyl group. It is particularly preferable that such a substituent as given above is to have a water-soluble group such as a hydroxy group, a COOM group, an amino group and a sulfo group. In Formula [I], the compounds represented by the following formulas A through F are particularly preferable.

Formula A

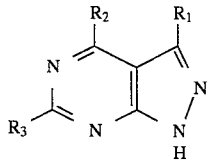

Formula B

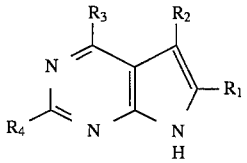

-continued

Formula C

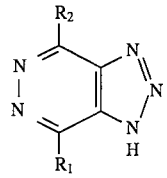

Formula D

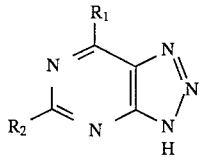

Formula E

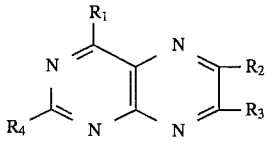

Formula F

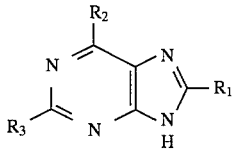

wherein $R_1$, $R_2$, $R_3$ and R4 each represents a hydrogen atom, a halogen atom, a lower alkyl group (including those having a substituent and, preferably, those having not more than 5 carbon atoms such as a methyl group and an ethyl group), an amino group (including those substituted and the substituents are each to have not more than 5 carbon atoms), a —$COOM_1$ group, a carbamoyl group (including those substituted) and a phenyl group (including those substituted); at least one of $R_1$, $R_2$, $R_3$ and $R_4$ represents an $SM_2$ group; and $M_1$ and $M_2$ represent each a hydrogen atom, an alkali-metal atom or an ammonium group.

$R_1$, $R_2$, $R_3$ and $R_4$ represent each preferably a hydroxy group, a —$COOM_1$ group, an amino group (including those substituted and the substituents are each to have not more than 5 carbon atoms), a sulfo group, or —$SM_2$ group.

The concrete examples of the compounds represented by Formula [I] will be given below. However, it should be understood that the present invention is by no means restricted to such specific examples.

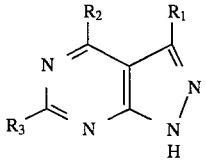

| | $R_1$ | $R_2$ | $R_3$ |
|---|---|---|---|
| 1 | H | H | SH |
| 2 | H | SH | H |
| 3 | $CH_3$ | H | SH |
| 4 | OH | H | SH |
| 5 | H | $NH_2$ | SH |
| 6 | Cl | SH | H |
| 7 | COOH | H | SH |

-continued

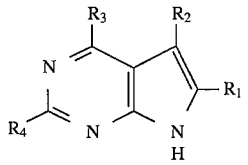

| | $R_1$ | $R_2$ | $R_3$ | $R_4$ |
|---|---|---|---|---|
| 8 | H | H | H | SH |
| 9 | Cl | H | H | SH |
| 10 | SH | H | H | H |
| 11 | $nC_5H_{11}$ | H | H | SH |
| 12 | OH | H | H | SH |
| 13 | H | H | OH | SH |
| 14 | SH | H | SH | H |

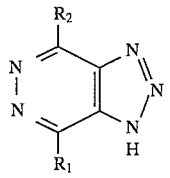

| | $R_1$ | $R_2$ |
|---|---|---|
| 15 | SH | H |
| 16 | SH | SH |
| 17 | SH | COOH |
| 18 | SH | $SO_3H$ |
| 19 | SH | OH |

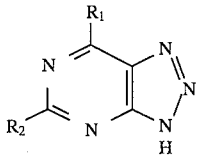

| | $R_1$ | $R_2$ |
|---|---|---|
| 20 | SH | H |
| 21 | SH | SH |
| 22 | SH | COOH |
| 23 | SH | $SO_3H$ |
| 24 | SH | OH |

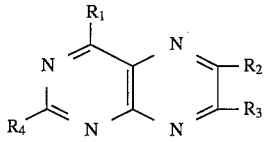

| | $R_1$ | $R_2$ | $R_3$ | $R_4$ |
|---|---|---|---|---|
| 25 | H | H | H | SH |
| 26 | H | H | SH | SH |
| 27 | OH | H | H | SH |
| 28 | H | $C_5H_{11}$ | H | SH |
| 29 | SH | COOH | H | H |
| 30 | H | H | $SO_3H$ | SH |

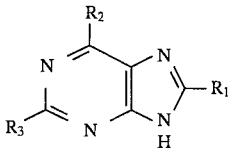

| | $R_1$ | $R_2$ | $R_3$ |
|---|---|---|---|
| 31 | SH | OH | H |
| 32 | SH | H | COOH |
| 33 | H | OH | SH |

-continued

| | | | |
|---|---|---|---|
| 34 | $SO_3H$ | SH | SH |
| 35 | H | SH | $SO_3H$ |

A compound of the invention represented by formula [I] may be used in an amount within the range of, preferably $10^{-5}$ to $10^{-1}$ mols per liter of a developer and, particularly $10^{-4}$ to $10^{-2}$ mols. The compounds of the invention have been well known and they are easily available.

A tetrazolium compound applicable to a light-sensitive material of the invention is represented by the following formula T;

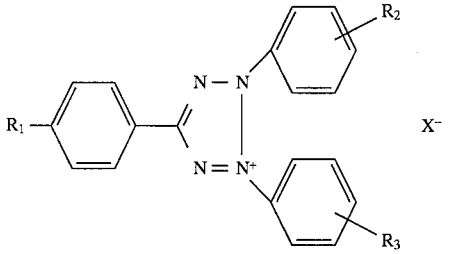

Formula T wherein $R_1$, $R_2$ and $R_3$ represent each a hydrogen atom or a substituent; and $X^-$ represents anion.

Now, a tetrazolium compound having the above-given formula T, that is applicable to the invention, will be detailed. In the above-given formula T, the preferable examples of the substituents represented by $R_1$ through $R_3$ include an alkyl group (such as those of methyl, ethyl, cyclopropyl, propyl, isopropyl, cyclobutyl, butyl, isobutyl, pentyl and cyclohexyl), an amino group, an acylamino group (such as those of acetylamino), a hydroxyl group, an alkoxy group (such as those of methoxy, ethoxy, propoxy, butoxy and pentoxy), an acyloxy group (such as those of acetyloxy), a halogen atom (such as those of fluorine, chlorine and bromine), a carbamoyl group, an acylthio group (such as those of acetylthio), an alkoxycarbonyl group (such as those of ethoxycarbonyl), a carboxyl group, an acyl group (such as those of acetyl), a cyano group, a nitro group, a mercapto group, a sulfoxy group and an aminosulfoxy group.

An anion represented by the above-denoted $X^{(-)}$ include, for example, a halogen ion such as a chloride ion, a bromide ion and an iodide ion, an acid radical of an inorganic acid such as nitric acid, sulfuric acid and perchloric acid, an acid radical of an organic acid such as sulfonic acid and carboxylic acid, an anionic type activator typically including a lower alkyl benzene sulfonic acid anion such as p-toluene sulfonic acid anion, a higher alkyl benzene sulfonic acid anion such as p-dodecyl benzene sulfonic acid anion, a higher alkyl sulfate anion such as lauryl sulfate anion, a boric acid type anion such as tetraphenyl boron, dialkyl sulfosuccinate anion such as di-2-ethylhexyl succinate anion, a polyether alcohol sulfate anion such as cetyl polyetheroxy sulfate anion, a higher aliphatic anion such as stearic acid anion, and a polymer attached with an acid radical such as polyacrylic acid anion.

Some concrete examples of the compounds of the invention represented by formula T will be given below. However, it should be understood that the present invention is by no means restricted to such specific examples.

| Compound No. | $R_1$ | $R_2$ | $R_3$ | $X^-$ |
|---|---|---|---|---|
| T-1 | H | H | H | $Cl^-$ |
| T-2 | H | p-$CH_3$ | p-$CH_3$ | $Cl^-$ |
| T-3 | H | m-$CH_3$ | m-$CH_3$ | $Cl^-$ |
| T-4 | H | o-$CH_3$ | o-$CH_3$ | $Cl^-$ |
| T-5 | p-$CH_3$ | p-$CH_3$ | p-$CH_3$ | $Cl^-$ |
| T-6 | H | p-$OCH_3$ | p-$OCH_3$ | $Cl^-$ |
| T-7 | H | m-$OCH_3$ | m-$OCH_3$ | $Cl^-$ |
| T-8 | H | o-$OCH_3$ | o-$OCH_3$ | $Cl^-$ |
| T-9 | p-$OCH_3$ | p-$OCH_3$ | p-$OCH_3$ | $Cl^-$ |
| T-10 | H | p-$C_2H_5$ | p-$C_2H_5$ | $Cl^-$ |
| T-11 | H | m-$C_2H_5$ | m-$C_2H_5$ | $Cl^-$ |
| T-12 | H | p-$C_3H_7$ | p-$C_3H_7$ | $Cl^-$ |
| T-13 | H | p-$OC_2H_5$ | p-$OC_2H_5$ | $Cl^-$ |
| T-14 | H | p-$OCH_3$ | p-$OCH_3$ | $Cl^-$ |
| T-15 | H | p-$OCH_3$ | p-$OC_2H_5$ | $Cl^-$ |
| T-16 | H | p-$OC_5H_{11}$ | p-$OCH_3$ | $Cl^-$ |
| T-17 | H | p-$OC_8H_{17}$-n | p-$OC_8H_{17}$-n | $Cl^-$ |
| T-18 | H | p-$Cl_2H_{25}$-n | p-$Cl_2H_{25}$-n | $Cl^-$ |
| T-19 | H | p-$N(CH_3)_2$ | p-$N(CH_3)_2$ | $Cl^-$ |
| T-20 | H | p-$NH_2$ | p-$NH_2$ | $Cl^-$ |
| T-21 | H | p-OH | p-OH | $Cl^-$ |
| T-22 | H | m-OH | m-OH | $Cl^-$ |
| T-23 | H | p-Cl | p-Cl | $Cl^-$ |
| T-24 | H | m-Cl | m-Cl | $Cl^-$ |
| T-25 | p-CN | p-$CH_3$ | p-$CH_3$ | $Cl^-$ |
| T-26 | p-SH | p-$OCH_3$ | p-$OCH_3$ | $Cl^-$ |
| T-27 | H | p-$OCH_3$ | p-$OCH_3$ | 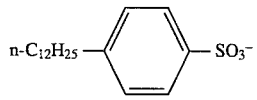 |

A tetrazolium compound applicable to the invention can easily be synthesized in accordance with the method described in, for example, Chemical Reviews, Vol. 55, pp. 335–483.

A tetrazolium compound applicable to the invention, represented by Formula T, may be used in an amount within the range of about not less than 1 mg to about 10 g and, preferably, about not less than 1 mg to about 2 g per mol of silver halide contained in a silver halide photographic light-sensitive material of the invention.

A tetrazolium compound applicable to the invention, represented by Formula T, may be used independently or in combination in a suitable proportion.

A hydrazine derivative applicable to the invention include, for example, a compound represented by the following formula H.

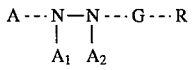

Formula H wherein A represents an aryl group or a heterocyclic group having at least one sulfur or oxygen atom; G represents a

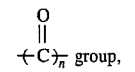

a sulfonyl group, a sulfoxy group,

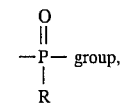

or an iminomethylene group; n is an integer of 1 or 2; $A_1$ and $A_2$ represent each a hydrogen atom or one of them represents a hydrogen atom and the other represents a substituted or unsubstituted alkylsulfonyl group; and R represents a hydrogen atom, an alkyl group, an aryl group, an alkoxy group, an aryloxy group, an amino group, a carbamoyl group, an oxycarbonyl group or an —O—$R_2$ group in which $R_2$ represents an alkyl group or a saturated heterocyclic group.

Among the above-given compounds in the invention, a compound represented by the following formula H-c or H-d is preferably used.

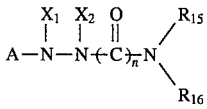

Formula H-c

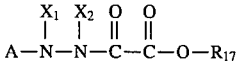

Formula H-d wherein A represents an aryl group or a heterocyclic group containing at least one sulfur or oxygen atom; n is an integer of 1 or 2, provided that, when n is 1, $R_{15}$ and $R_{16}$ represent each a hydrogen atom, an alkyl group, an alkenyl group, an alkenyl group, an aryl group, a heterocyclic group, a hydroxy group, an alkoxy group, an alkenyloxy group, an alkenyloxy group, an aryloxy group or a heterocyclicoxy group, and $R_{15}$ and $R_{16}$ are also allowed to form a ring, together with a nitrogen atom, and that, when n is 2, $R_{15}$ and $R_{16}$ represent each a hydrogen atom, an alkyl group, an alkenyl group, an alkinyl group, an aryl group, a saturated or unsaturated heterocyclic group, a hydroxy group, an alkoxy group, an alkenyloxy group, an alkinyloxy group, an aryloxy group or a heterocyclic-oxy group, provided that, when n is 2, at least one of $R_{15}$ and $R_{16}$ is to represent an alkenyl group, an alkinyl group, a saturated heterocyclic group, a hydroxy group, an alkoxy group, an alkenyloxy group, an alkinyloxy group, an aryloxy group or a heterocyclic-oxy group; and $R_{17}$ represents an alkinyl group or a saturated heterocyclic group.

In Formulas H-c and H-d, $X_1$ and $X_2$ represents each a hydrogen atom, a sulfonyl group (such as those of methane sulfonyl and toluene sulfonyl), an acyl group (such as those of acetyl, trifluoroacetyl and ethoxy carbonyl) and a $$-\overset{O}{\overset{\|}{C}}-\overset{O}{\overset{\|}{C}}-X_3 \quad \text{group}$$

(such as those of ethoxalyl and pyruvoyl). $X_3$ represents hydrogen atom, alkyl or carboxyl group.

To be more detailed, A represents an aryl group (such as those of phenyl and naphthyl) or a heterocyclic group having at least one sulfur or oxygen atom (such as those of thiophene, furan, benzothiophene and pyran).

$R_{15}$ and $R_{16}$ represent each a hydrogen atom, an alkyl group (such as those of methyl, ethyl, methoxyethyl, cyanoethyl, hydroxyethyl, benzyl, trifluoroethyl), an alkenyl group (such as those of allyl, butenyl, pentenyl, pentadienyl), an alkinyl group (such as those of propargyl, butynyl, pentenyl), an aryl group (such as those of phenyl, naphthyl, cyanophenyl, methoxyphenyl), a heterocyclic group (including an unsaturated heterocyclic group such as those of pyridine, thiophene, furan, and a saturated heterocyclic group such as those of tetrahydrofuran, sulfolane), a hydroxy group, an alkoxy group (such as those of methoxy, ethoxy, benzyloxy, cyanomethoxy), an alkenyloxy group (such as those of allyloxy and butenyloxy), an alkinyloxy group (such as those of propargyloxy, butynyloxy), an aryloxy group (such as those of phenoxy, naphthyloxy), or a heterocyclicoxy group (such as those of pyridyloxy, pyrimidyloxy); provided that, when n is 1, $R_{15}$ and $R_{16}$ may form a ring (such as those of piperidine, piperazine, morpholine), together with a nitrogen atom.

provided, when n is 2, at least one of $R_{15}$ and $R_{16}$ represents an alkenyl group, an alkinyl group, a saturated heterocyclic group, a hydroxy group, alkoxy group, an alkenyloxy group, an alkinyloxy group, an aryloxy group or a heterocyclicoxy group.

The concrete examples of an alkinyl group and a saturated heterocyclic group each represented by $R_{17}$ include such a group as given above.

It is allowed to introduce various substituents into an aryl group or a heterocyclic group having at least one sulfur or oxygen atom, each represented by A. The substituents introducible thereto include, for example, a halogen atom, an alkyl group, an aryl group, an alkoxy group, an aryloxy group, an acyloxy group, an alkylthio group, an arylthio group, a sulfonyl group, an alkoxycarbonyl group, an aryloxy carbonyl group, a carbamoyl group, a sulfamoyl group, an acyl group, an amino group, an alkylamino group, an arylamino group, an acylamino group, a sulfonamido group, an arylaminothiocarbonylamino group, a hydroxy group, a carboxy group, a sulfo group, a nitro group, and a cyano group. Among these substituents, a sulfonamido group is preferably used.

In each of the formulas given above, A is preferable to contain at least one diffusion-resistive group or a silver halide adsorption-accelerative group. As for the diffusion-resistive groups, it is preferable to use a ballast group for a coupler and so forth that has commonly been used in an immobile photographic additive. A ballast group is a group having not less than 8 carbon atoms, that is photographically inert as compared to others, and it may be selected out of an alkyl group, a phenyl group, an alkylphenyl group, a phenoxy group and an alkylphenoxy group, for example.

The silver halide adsorption-accelerative groups include, for example, the groups given in U.S. Pat. No. 4,385,108 such as a thiourea group, a thiourethane group, a heterocyclic thioamido group, a mercapto-heterocyclic group and a triazole group.

A compound more preferable in the invention is a compound represented by formula H-c, provided, when n is 2, and a compound represented by formula H-d.

Among the compounds represented each by formula H-c, when n is 2, a compound is further preferable provided that $R_{15}$ and $R_{16}$ represent each a hydrogen atom, an alkyl group, an alkenyl group, an alkinyl group, an aryl group, a saturated or unsaturated heterocyclic group, a hydroxy group or an alkoxy group, and at least one of $R_{31}$ and $R_{32}$ represents an alkenyl group, an alkinyl group, a saturated heterocyclic group, a hydroxy group or an alkoxy group.

The typical compounds represented by the foregoing formulas H-c and H-d include, for example, those given below. As it is the matter of course, the concrete compounds applicable to the invention, represented by formulas H-c and H-d, shall not be limited thereto.

Concrete examples of the compounds

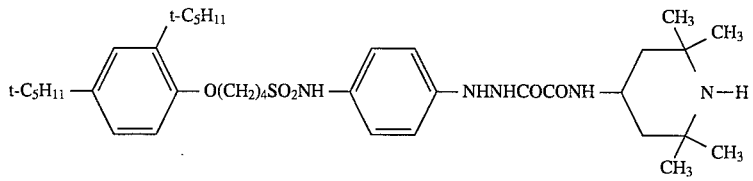

c-1

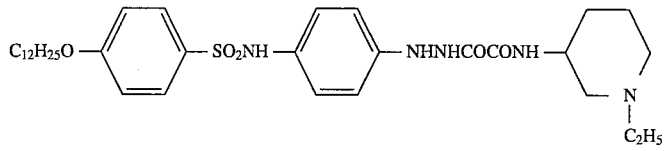

c-2

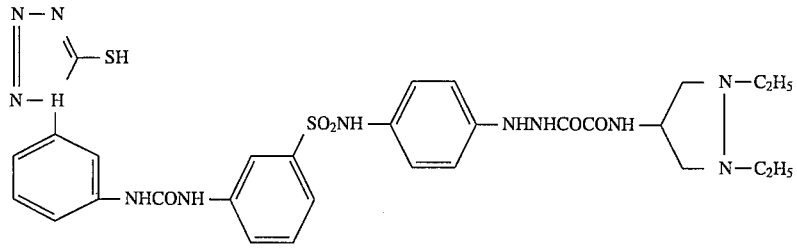

c-3

-continued
d-1
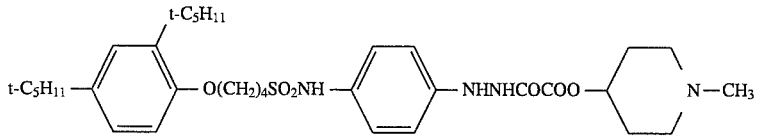
c-4
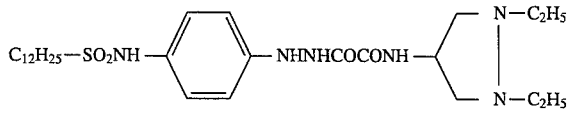
c-5
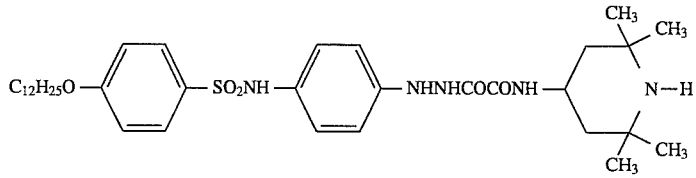
d-2
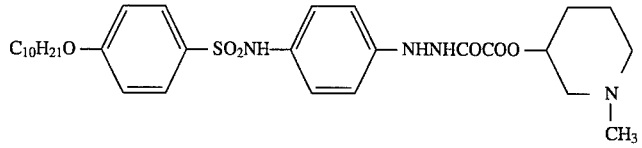
c-6
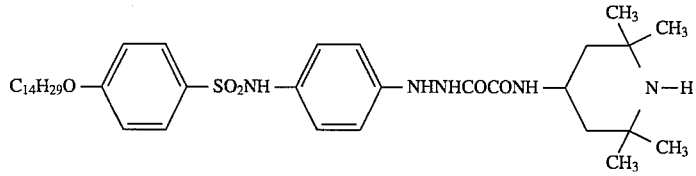
d-3
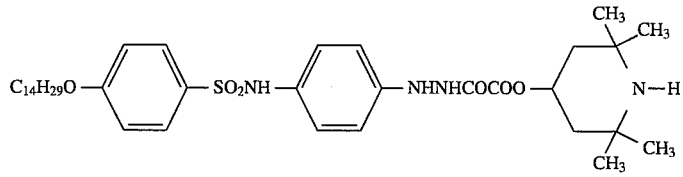
c-7
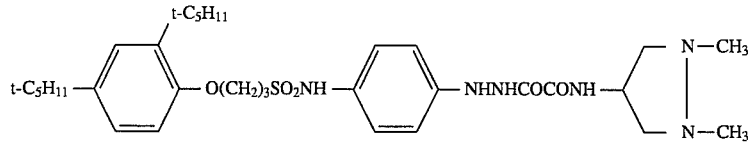
d-4
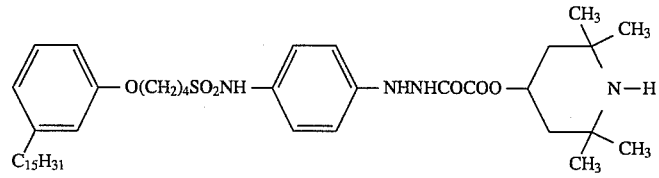
c-8
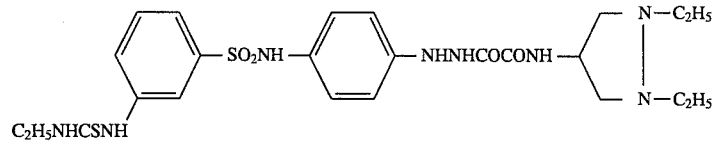

-continued d-5

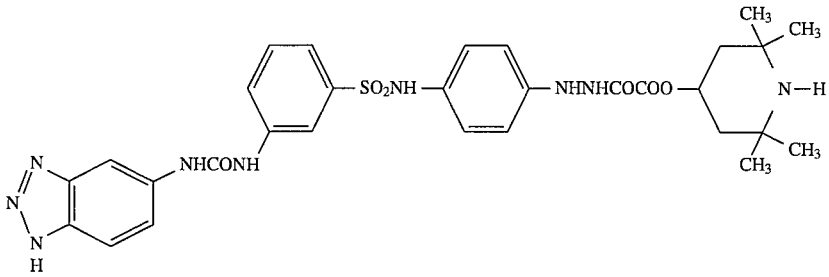

The other concrete compounds than the above include, for example, those exemplified by (1) through (61) and (65) through (75) given in JP OPI Publication No. 2-841/1990, pp. 542(4)–546(8).

A hydrazine derivative relating to the invention can be synthesized in the procedures detailed in JP OPI Publication No. 2-841/1990, pp. 546(8)–550(12).

A hydrazine derivative relating to the invention may be added in such a position as a silver halide emulsion layer and/or the adjacent layers thereto. It may be added in an amount within the range of, preferably, $1\times10^{-6}$ to $1\times10^{-1}$ mols per mol of silver and, more preferably, $1\times10^{-5}$ to $1\times10^{-2}$ mols.

When a hydrazine derivative is added to, it is preferable to contain a nucleation-accelerating agent in a silver halide emulsion layer and/or a light-insensitive layer on the silver halide emulsion layer side of a support. It is more preferable to contain at least one kind of a nucleation-accelerating agent represented by the following formula Na in a silver halide emulsion layer and/or a light-insensitive layer on the silver halide emulsion layer side of a support.

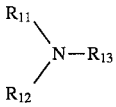

Formula Na wherein $R_{11}$, $R_{12}$ and $R_{13}$ represent each a hydrogen atom, a substituted or unsubstituted alkyl group, a substituted or unsubstituted alkenyl group, a substituted or unsubstituted alkinyl group, a substituted or unsubstituted aryl group. A ring can be formed of $R_{11}$, $R_{12}$ and $R_{13}$. Formula Na, preferably represents an aliphatic tertiary amine compound.

Among the compounds represented by formula Na, a compound represented by formula III given in U.S. Pat. No. 5,229,248, p. 85 is more preferable.

Further, these compounds are preferable to have a diffusion-resistive group (or a ballast group) or a silver halide adsorption group in the molecules thereof. For providing a diffusion-resistive group thereto, a compound having a molecular weight of, preferably, not less than 100 and, more preferably, not less than 300. The preferable adsorption groups include, for example, a heterocyclic group, a mercapto group, a thioether group, a thione group and a thiourea group.

Now, the concrete examples of the nucleation-accelerators Na will be given below.

Na-1

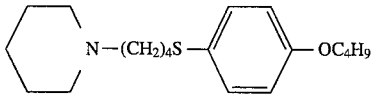

Na-2

$[(C_3H_7)_2N(CH_2)_3OCH_2CH_2]_2S$

Na-3

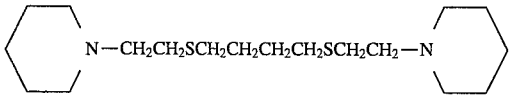

Na-4

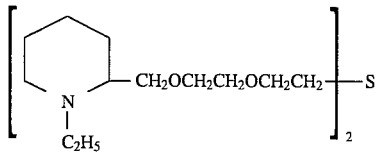

Na-5

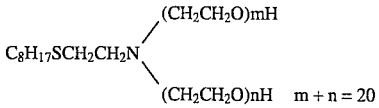

-continued
Na-6
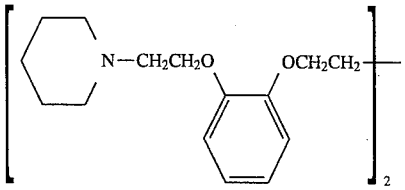
Na-7
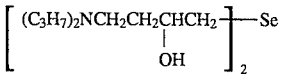
Na-8
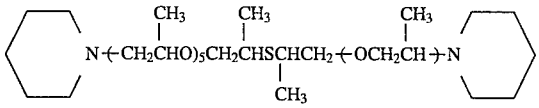
Na-9
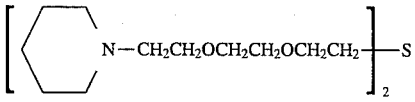
Na-10
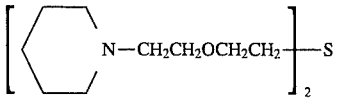
Na-11
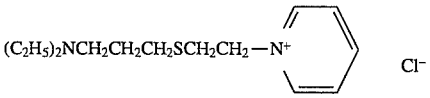
Na-12
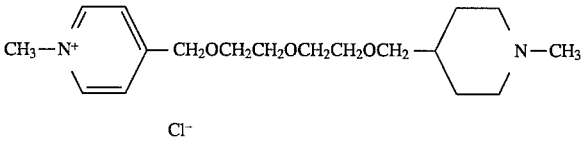
Na-13
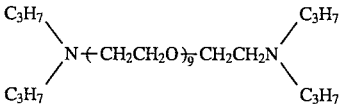
Na-14
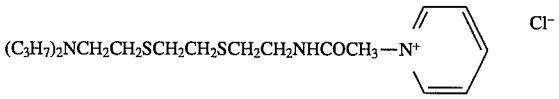
Na-15
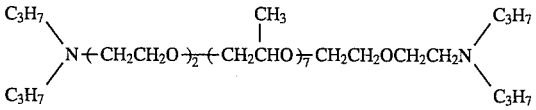
Na-16
$[(C_2H_5)_2N(CH_2)_3NHCOCH_2]_2Se$
Na-17
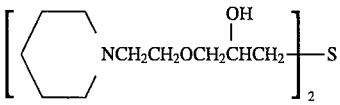
Na-18
$(C_2H_5)_2NCH_2CH_2(OCH(CH_3)CH_2)_7SCH_2CH_2N(C_2H_5)_2$
Na-19
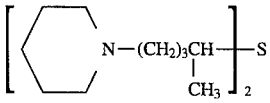

-continued

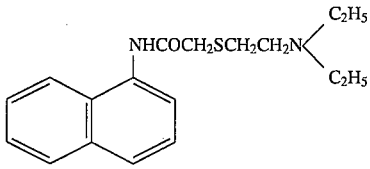

Na-20

As for the other preferable compounds than the above, there are the compounds given in U.S. Pat. No. 5,229,248, pp. 80–125.

A hydrazine derivative applicable to the invention or a nucleation-accelerating agents applicable thereto may be used in any layer, provided, the layer is on a silver halide emulsion layer side. However, it is preferable to use the derivative or the accelerating agent in a silver halide emulsion layer and/or the adjacent layers thereto. An optimum amount of the derivative or the accelerating agent to be added is varied according to a grain-size of silver halide, a halogen composition, a chemical sensitization degree and the kind of a inhibitor. However, it is generally added in an amount within the range of, preferably, $10^{-6}$ to $10^{-1}$ mols per mol of silver halide used and, particularly, $10^{-5}$ to $10^{-2}$ mols.

A hydrazine derivative or a nucleation-accelerating agent applicable to the invention may be added at any point of time in the step of preparing a silver halide photographic light-sensitive material (for example, in the step of forming silver halide grains, between the time after completing a grain formation and the time of carrying out a chemical sensitization, or between the time after completing a chemical sensitization and the time of carrying out a coating operation). It is also allowed that the derivative or the accelerating agent is added in a light-sensitive material by spraying or coating a solution containing the hydrazine derivative or nucleation-accelerating agent after coating the light-sensitive material.

When adding a hydrazine derivative or nucleation-accelerating agent applicable to the invention, they are dissolved in various solvents (including, for example, water, methanol, ethanol, acetone, ethyl acetate, dimethyl formamide and various kinds of high-boiling solvents) and are then added thereto. In another adding method, after they are dissolved in a solvent, the resulting solution and a gelatin solution are dispersed together by a supersonic dispersion or a media dispersion used with a ball-mill, and then they are added in the form of the above-mentioned dispersed solution. In a further method, after dissolving a hydrazine derivative and a nucleation-accelerating agent in a solvent, the pH is so varied as to precipitate. The resulting solid fine particles, the hydrazine derivative and nucleation-accelerating agent are media-dispersed with a ball-mill, so that they can be added in the form of solid fine particles.

A silver halide emulsion applicable to the invention (hereinafter referred to as the silver halide emulsion or simply the emulsion, and so forth.) comprises silver chlorobromide, silver iodochlorobromide or silver chloride, each containing silver chloride in a proportion within the range of, for example, 60 mol % to 100 mol %.

Monodisperse grains having a variation coefficient of not more than 15% is preferably used. The above-mentioned variation coefficient is represented by the following formula; (A standard grain-size deviation)/(An average grain size)× 100.

A silver halide emulsion may be applied with various techniques having been known in the art, an additive and so forth.

For example, in a silver halide photographic emulsion and a backing layer each applicable to the invention, a variety of a chemical sensitizer, a color toner, a layer hardener, a surfactant, a thickener, a plasticizer, a lubricant, a development inhibitor, a UV absorbent, an anti-irradiation dye, a heavy metal and a matting agent can further be contained in various methods. Besides, in a silver halide photographic emulsion and a backing layer of the invention, a polymer latexes may also be contained.

The above-given additives are further detailed in Research Disclosure, Vol. 176, Item 17643, (Dec., 1978) and, ibid., Vol. 187, Item 18716, (Nov., 1979). The additives are detailed in the following pages and columns thereof.

| Additive | RD-17643 | RD-18716 |
|---|---|---|
| 1. Chemical sensitizer | p. 23 | p. 648 in the right column |
| 2. Sensitivity improver | | p. 648 in the right column |
| 3. Spectral sensitizer & Super-sensitizer | pp. 23–24 | pp. 648–649 in the right col. |
| 4. Whitening agent | p. 24 | |
| 5. Antifoggant & stabilizer | pp. 24–25 | p. 649 in the right col. |
| 6. Light absorbent, filter dye & UV-absorbent | pp. 25–26 | pp. 649 in the right col. to p. 650 in the left col. |
| 7. Antistaining agent | p. 25 in the right col. | p. 650 in the left col. to the right col. |
| 8. Dye-image stabilizer | p. 25 | |
| 9. Layer hardener | p. 26 | p. 651 in the left col. |
| 10. Binder | p. 26 | p. 651 in the left col. |
| 11. Plasticizer & lubricant | p. 27 | p. 650 in the right col. |
| 12. Coating aid & surfactant | pp. 26–27 | p. 650 in the right col. |
| 13. Antistatic agent | p. 27 | p. 650 in the right col. |

The supports applicable to a silver halide photographic light-sensitive material of the invention include, for example, cellulose acetate, cellulose nitrate, a polyester such as polyethylene terephthalate, a polyolefin such as polyethylene, polystyrene, baryta paper, polyolefin-coated paper, glass and a metal. These supports may be sub-treated, if required.

EXAMPLES

Now, some concrete examples of the invention will be detailed below. However, it should be understood that the present is by no means restricted to such specific examples.

Example 1

(Preparation of silver halide photographic emulsion A)

In a double-jet precipitation method, a silver chlorobromide emulsion (having a silver chloride content of 70 mol % per mol of silver) was prepared. When making the precipitation, $K_2IrCl_6$ was added in an amount of $8\times10^{-7}$ mols per mol of silver. The resulting emulsion was proved to be an emulsion comprising cubic, monodispersed grains having an average grain-size of 0.20 μm (having a variation coefficient of 9%). After adding SD-1 in an amount of 8 mg/m$^2$, a washing treatment and a desalting treatment were carried out in the ordinary methods, respectively. After completing the desalting treatment, the pAg of the resulting emulsion was 8.0 at 40° C. Thereafter, a mixture of [A], [B] and [C] was added and a gold-sulfur sensitization was carried out, so that emulsion A could be prepared.

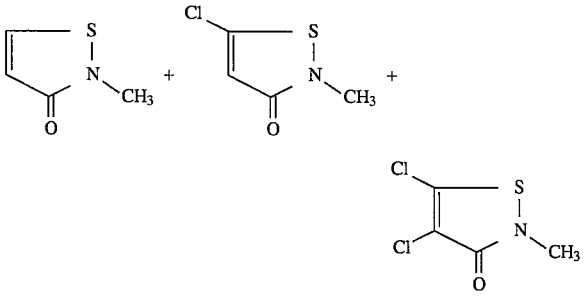

Amount of [A], [B] and [C] added together: 5 mg/m$^2$,

Mixture ratio of [A], [B] and [C] added: 46:50:4 (in mol)

Sensitizing dye: SD-1

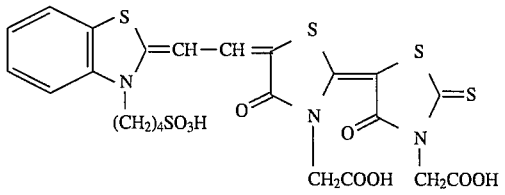

(Preparation of a silver halide photographic light-sensitive material)

On a sublayer-coated side of a 100 μm-thick polyethylene terephthalate film coated with a 0.1 μm-thick sublayer on each of the both sides thereof (See Example 1 given in JP OPI Publication No. 59-19941/1984), a silver halide emulsion layer having the following chemical formula (1) was coated so that the gelatin amount and the silver amount could be 2.0 g/m$^2$ and 3.2 g/m$^2$, respectively, and thereon, an emulsion protective layer having the following chemical formula (2) was coated so that the gelatin amount could be 1.0 g/m$^2$. On the opposite side of the sublayer, a backing layer having the following chemical formula (3) was coated so that the gelatin amount could be 2.4 g/m$^2$. Further thereon, a backing protective layer having the following chemical formula (4) was coated so that the gelatin amount could be 1 g/m$^2$, so that a sample could be prepared.

Chemical formula (1)
(the composition of a silver halide emulsion layer)

| | |
|---|---|
| Gelatin | An amount to be 2.0 g/m$^2$ as an emulsion layer |
| Silver halide emulsion A | 3.2 g/m$^2$ (in silver content) |
| Sensitizing dye: SD-2 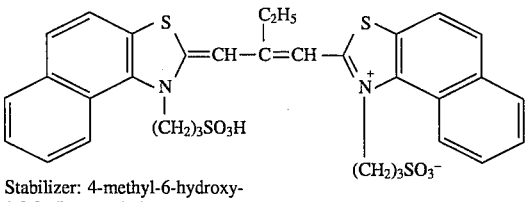 | 1.0 mg/m$^2$ |
| Stabilizer: 4-methyl-6-hydroxy-1,3,3a,7-tetrazaindene | 30 mg/m$^2$ |
| ST-1 | 40 mg/m$^2$ |
| Antifoggant: 5-nitroindazole | 5 mg/m$^2$ |
| Surfactant: saponin | 0.1 g/m$^2$ |
| Surfactant: S-1 | 8 mg/m$^2$ |
| $CH_2COO(CH_2)_9CH_3$ / $CH_2COO(CH_2)_2CH<^{CH_3}_{CH_3}$ / $SO_3Na$ | |
| Hydrazine derivatives: | |
| C-7 | 25 mg/m$^2$ |
| C-8 | 2 mg/m$^2$ |
| Nucleation-accelerating agent: | |
| Na-20 | 2 mg/m$^2$ |
| Na-15 | 20 mg/m$^2$ |
| Na-3 | 10 mg/m$^2$ |
| ST-1 | |

-continued

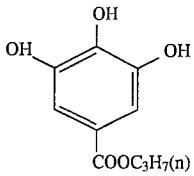

50 mg/m²

Latex polymer: Lx-1

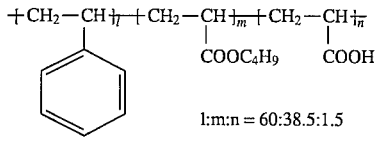

1 g/m² l:m:n = 60:38.5:1.5

Polyethylene glycol (Having a molecular weight: 4,000) — 0.1 g/m²

Chemical formula (2)
(Composition of an emulsion protective layer)

Gelatin — 0.9 g/m²

Surfactant: S-2

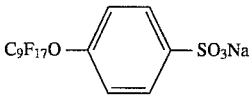

10 g/m²

Surfactant: S-3

5 mg/m²

Matting agent: Monodispersed silica having an average particle size of 3.5 μm — 5 mg/m²

Layer hardener: 1,3-vinyl sulfonyl-2-propanol — 80 mg/m²

Chemical formula (3) (Composition of a backing layer)

(a)

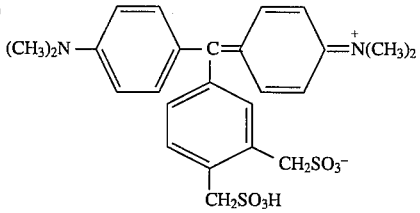

70 mg/m²

(b)

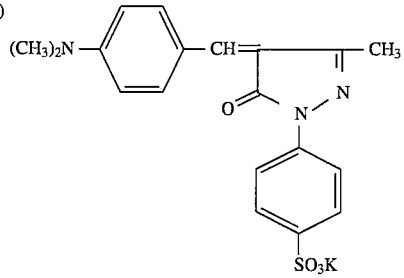

50 mg/m²

-continued

| | |
|---|---|
| (c) 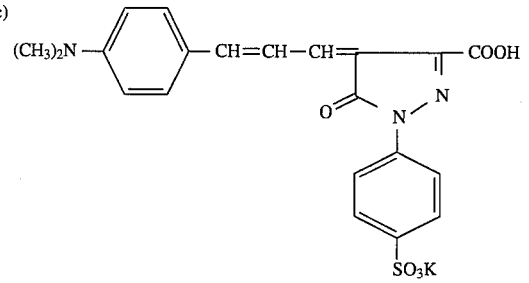 | 20 mg/m$^2$ |
| Gelatin | 2.4 g/m$^2$ |
| Surfactant: saponin | 0.1 g/m$^2$ |
| Surfactant: S-1 | 6 mg/m$^2$ |
| Colloidal silica | 100 mg/m$^2$ |

Chemical formula (4)

(Composition 35 of a backing protective layer)

| | |
|---|---|
| Gelatin | 1 g/m$^2$ |
| Matting agent: monodispersed polymethyl methacrylate having an average particle size of 3.5 μm | 40 mg/m$^2$ |
| Surfactant: S-2 | 10 mg/m$^2$ |
| Layer hardener: Glyoxal | 25 mg/m$^2$ |
| Layer hardener: H-1 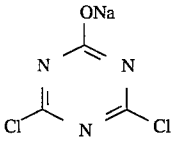 | 35 mg/m$^2$ |

(Evaluation on the photographic characteristics)

The resulting sample was brought into close contact with a wedge and was then exposed to He-Ne laser beam for $10^{-6}$ seconds. Thereafter, it was processed under the following conditions, through a rapid-processing type automatic processor Model GR-26SR manufactured by Konica Corp into which the developer and fixer each having the compositions shown in Table 1, respectively.

With the resulting sample, the density thereof was measured through a Konica optical densitometer Model PDA-65. The sensitivity thereof was indicated by a value relative to the sensitivity obtained from a density of 2.5 obtained when the fresh solutions were used, that was regarded as a value of 100, and the gamma thereof was indicated by a value of a density of 0.1 made tangent to a density of 2.5. When a gamma was less than 8.0, the sample was not practically applicable, because the resulting contrast was not satisfactorily hard.

(Evaluation on black spots)

The unexposed portions of the resulting processed sample was visually observed through a 40× magnifier. A sample having no black spot at all was evaluated as the highest rank "5", and the rest of the samples were evaluated by lowering the ranks thereof as "4", "3", "2" and "1" in order so as to correspond to the degrees of the black spots produced. Ranks "2" and "1" were on the impractically applicable levels.

TABLE 1

| | Starter for a developer | Replenishing solution 1 | Replenishing solution 2 | Replenishing solution 3 | Replenishing solution 4 |
|---|---|---|---|---|---|
| Pentasodium diethylene triamine penta acetate | 90.75 g | 90.75 g | 90.75 g | 90.75 g | 90.75 g |
| Sodium sulfite | 1314.5 g | 1314.5 g | 1314.5 g | 1314.5 g | 1314.5 g |
| Boric acid | 200 g | 200 g | 200 g | 200 g | 200 g |
| Potassium bromide | 125 g | 125 g | 125 g | 150 g | 125 g |
| Potassium carbonate | 1000 g | 1000 g | 1000 g | 1000 g | 1000 g |
| Compound example 33 | 1.5 g | 1.5 g | 1.5 g | 1.5 g | 1.5 g |
| Diethylene glycol | 1000 g | 1000 g | 1000 g | 1000 g | 1000 g |
| Benzotriazole | 4 g | 4 g | 4 g | 4 g | 4 g |
| Hydroquinone | 525 g | 525 g | 525 g | 525 g | 525 g |
| 1-phenyl-4-methyl-hydroxymethyl-3-pyrazolidone | 22 g | 22 g | 22 g | 22 g | 18 g |
| 1-phenyl-5-mercaptotetrazole | 0.5 g | 0.5 g | 0.5 g | 0.6 g | 0.5 g |

TABLE 1-continued

| | Starter for a developer | Replenishing solution 1 | Replenishing solution 2 | Replenishing solution 3 | Replenishing solution 4 |
|---|---|---|---|---|---|
| Add an aqueous potassium hydroxide solution to have a pH of | pH 10.7 | pH 10.7 | pH 10.6 | pH 10.7 | pH 10.7 |
| Add water to make | 10 l | 10 l | 10 l | 10 l | 10 l |
| Before using the solution, add water to make | 25 l | 27 l | 25 l | 25 l | 25 l |
| pH valve | 10.4 | 10.4 | 10.3 | 10.4 | 10.4 |
| Remark | | Varying dilution | lower pH | Amount of developing inhibitor is lower | Amount of developing agent is lower |
| Activity* | 100 | 90 | 88 | 90 | 90 |

*The activity of the starter for the developer was regarded as a value of 100.

Formula of a fixer

| | |
|---|---|
| Ammonium thiosulfate (in an aqueous 70% W/V solution) | 6000 ml |
| Sodium sulfite | 720 g |
| Sodium acetate· trihydrate | 959.4 g |
| Boric acid | 293.4 g |
| Acetic acid (in an aqueous 90% W/V solution) | 410.1 ml |
| Tartaric acid | 90 g |
| Alumina sulfate (in an aqueous 8.1% W/V solution in terms of the $Al_2O_3$ content) | 600 ml |
| Add water to make 10.9 liters of a conc. solution | |

When making use of the fixer, water was added thereto so as to make 30 liters. When making use of the fixer, the pH thereof was set to be 4.9.

(Conditions for the processing) It included the crossover time.

| (Processing step) | (Temperature) | (Time) |
|---|---|---|
| Developing step | 38° C. | 12 sec. |
| Fixing step | 35° C. | 10 sec. |
| Washing step | 30° C. | 10 sec. |
| Drying step | 50° C. | 13 sec. |
| Total: | | 45 sec. |

In the experiment, by making use of only a starter for a developer the processing was kept on all day long (for 8 hours) without replenishing any developer and, after stopping the processing in operation overnight, an amount of developer replenishing-solution, was obtained, and a solution having a relatively low activity was so replenished as to reach the substantially same activity level.

The above-mentioned replenishment was varied according to an automatic processor (particularly, the tank capacity and aperture ratio thereof), a developer, a processing temperature, a light-sensitive material and so forth. The expression, "- - - to make the activity of a solution the same as - - - ", stated in this case means that the sensitivity of a light-sensitive material obtained in the next morning becomes the same as that obtained in yesterday morning.

In Experiments 2 through 5, for controlling the activity the same as that obtained in yesterday morning, it was suitable to replenish 1000 ml of a developer replenishing solution having a low activity. In Experiments 2 through 5, a starter for a developer was replenished after the replenishing amount was reached 1000 ml.

The total amounts of the developer replenishing-solution employed in experiments 2 to 5, experiment 6 and experiment 7 per a day are respectively 3500 ml, 3700 ml and 4500 ml.

The results of the above-mentioned experiments will be shown in Table 2.

A starter for a developer is a developing solution prepared on the first day of experiments.

TABLE 2

| Experiment No. | Replenishing solution | Processed numbers of 50.8 × 61.0 mm-sized sheets. | Sensitivity | | Gamma | | Fog | | Black spot | | Remarks |
|---|---|---|---|---|---|---|---|---|---|---|---|
| | | | Fresh solution | Solution used for 30 days | Fresh solution | Solution used for 30 days | Fresh solution | Solution used for 30 days | Fresh solution | Solution used for 30 days | |
| 1 | Starter | 50 shts. | 100 | 130 | 11.5 | 11.2 | 0.03 | 0.045 | 5 | 1 | Comp. |
| 2 | Replenisher 1 and Starter | 50 shts. | 100 | 99 | 11.5 | 11.5 | 0.03 | 0.03 | 5 | 5 | Inv. |
| 3 | Replenisher 2 and Starter | 50 shts. | 100 | 101 | 11.5 | 11.5 | 0.03 | 0.03 | 5 | 5 | Inv. |
| 4 | Replenisher 3 and Starter | 50 shts. | 100 | 99 | 11.5 | 11.5 | 0.03 | 0.03 | 5 | 5 | Inv. |
| 5 | Replenisher 4 and Starter | 50 shts. | 100 | 97 | 11.5 | 11.4 | 0.03 | 0.03 | 5 | 5 | Inv. |
| 6 | Replenisher 1 and Starter | 50 shts. | 100 | 100 | 11.5 | 11.5 | 0.03 | 0.04 | 5 | 5 | Inv. |
| 7 | Starter | 50 shts, | 100 | 104 | 11.5 | 11.5 | 0.03 | 0.04 | 5 | 4 | Comp. |

TABLE 2-continued

| Experiment No. | Replenishing solution | Processed numbers of 50.8 × 61.0 mm-sized sheets. | Sensitivity | | Gamma | | Fog | | Black spot | | Remarks |
|---|---|---|---|---|---|---|---|---|---|---|---|
| | | | Fresh solution | Solution used for 30 days | Fresh solution | Solution used for 30 days | Fresh solution | Solution used for 30 days | Fresh solution | Solution used for 30 days | |

Comp.: Comparison
Inv.: Invention
In experiment 1, 50 full-sheet of papers were processed while a starter for a developer was replenished in an amount of every 50 ml per a full-sheet of paper (50.8 × 61.0 mm sized light-sensitive material) to get a photographic density of 80%.
In experiments 2 to 5, replenishing-solutions 1 to 4 was added by 1000 ml respectively and then, 50 full-sheet of papers were processed while the starter for the developer was replenished in an amount of every 50 ml per the full-sheet of paper to get a photographic density of 80%.
In experiment 6, 20 full-sheet of papers were processed while replenishing solution 1 was replenished in an amount of every 50 ml per full-sheet of paper to get a photographic density of 80%, and then, 30 full-sheet of papers were processed while the starter for a developer was replenished in an amount of every 90 ml per the full-sheet of paper to get a photographic density of 80%.
In experiment 7, 50 full-sheet of papers were processed while the starter for a developer was replenished in an amount of every 90 ml per a full-sheet of paper to get a photographic density of 80%.

As is obvious from the results shown in Table 2, in Experiments 1 and 7, the sensitivity was increased and the fog and black spots were deteriorated. In Experiments 2 through 6 each of the invention, in contrast to the above, a stable processing could be performed as same as in making use of a fresh solution.

In experiment 7 (comparative sample), to obtain the same improved results as the present invention in Sensitivity, Gamma, Fog and Black spot, a large replenishing amount (90ml) should be employed compared with a replenishing amount (50ml) of experiments 2 through 6 (inventive samples).

Example 2

(Preparation of emulsion B)

An aqueous solution of 0.13 mols of silver nitrate and an aqueous halide solution containing 0.04 mols of potassium bromide and 0.09 mols of sodium chloride were each added to an aqueous gelatin solution containing sodium chloride at 60° C. for 12 minutes with stirring, so that a nucleation was carried out by obtaining silver chlorobromide grains having an average grain-size of 0.13 μm and a silver chloride content of 70 mol %. Successively in the similar manner, an aqueous solution of 0.87 mols of silver nitrate and an aqueous halide solution containing 0.26 mols of potassium bromide and 0.65 mols of sodium chloride were each added thereto in a double-jet method by taking 20 minutes. Thereafter, the resulting mixture was washed in a flocculation method according to an ordinary method. Gelatin of 50 g was added thereto and the pH and pAg thereof were adjusted to be 6.0 and 7.5, respectively. Further, 127 mg of deoxyribonucleic acid, 5 mg of sodium thiosulfate and 8 mg of chloroauric acid each per mol of silver were added thereto. The resulting mixture was heated at 60° C. for 75 minutes and was then subjected to a chemical sensitization treatment. After that, 150 mg of 4-hydroxy-6 -methyl-1,3,3a,7-tetrazaindene was added as a stabilizer. The resulting grains were proved to be silver chlorobromide cubic grains having an average grain-size of 0.25 μm and a silver chloride content of 70%.

(Preparation of coated sample)

As a sensitizing dye, 1-(β-hydroxyethyl)-3-phenyl-5-[(3 -α-sulfopropyl-α-benzoxazolidene)-ethylidene]thiohydantoin was added in an amount of 150 mg per mol of silver halide contained in an emulsion.

And, as a tetrazolium compound, the foregoing compound T- 13 was added in an amount of 800 mg/Ag mol. Further, 300 mg of sodium p-dodecylbenzene sulfonate, 2 g of styrene-maleic acid copolymer and 15 g of styrene-butyl acrylate-acrylic acid copolymer latex (having an average particle-size of 0.25 μm) were each added. The resulting mixture was coated on a subbed polyethylene terephthalate film base of which is described in Example (1) of JP OPI Publication No. 59-19941/1984, so that Ag amount and Gelatin amount could be 3.5 g/m$^2$ and 2.0 g/m$^2$, respectively. At that time, sodium 1-decyl-2-(3 -isopentyl)succinate-2-sulfonate was added in an amount of 30 mg/m$^2$ as a spreading agent so that the gelatin amount could be 1.0 g/m$^2$ and, further, a protective layer containing formalin in an amount of 25 mg/m$^2$ as a layer hardener was simultaneously multilayer-coated. With each of the resulting samples, the following sensitometry was tried.

<Exposure to light>

A tungsten photosensitometer, 2854K, 5"

<Processing conditions>

| (Step) | (Temperature) | (Time) |
|---|---|---|
| Developing | 34° C. | 15 sec. |
| Fixing | 34° C. | 15 sec. approx. |
| Washing | at an ordinary temp. | 12 sec. approx. |
| Drying | 50° C. | 10 sec. |

The development starter, development replenisher and fixer were used as same as in Example 1.

With the processed samples, the photographic characteristic curves thereof were made out. The contrasts thereof were each indicated by the gamma values to the exposure quantities capable of giving the optical densities of 0.2 and 1.5, respectively.

The resulting sensitivities were indicated by a value relative to the sensitivity obtained from Sample No. 1 that was regarded as a value of 100.

The sensitivity, contrast and fogginess of each sample will be shown in Table 3.

A starter for a developer is a developing solution prepared on the first day of experiments.

In Experiments 22 through 26, for making the activity the same as that obtained in yesterday morning, it was suitable to replenish 800 ml of a replenisher having a low activity.

The total amounts of the developer replenishing-solution employed in experiments 22 to 25, experiment 26 and experiment 27 per a day, are respectively 2800 ml, 3050 ml and 3750 ml.

TABLE 3

| Experiment No. | Replenishing solution | Processed numbers of 50.8 × 61.0 mm-sized sheets. | Sensitivity Fresh solution | Sensitivity Solution used for 30 days | Gamma Fresh solution | Gamma Solution used for 30 days | Fog Fresh solution | Fog Solution used for 30 days | Remarks |
|---|---|---|---|---|---|---|---|---|---|
| 21 | Starter | 50 shts. | 100 | 125 | 11.1 | 9.8 | 0.03 | 0.05 | Comp. |
| 22 | Replenisher 1 and Starter | 50 shts. | 100 | 100 | 11.1 | 11.0 | 0.03 | 0.03 | Inv. |
| 23 | Replenisher 2 and Starter | 50 shts. | 100 | 101 | 11.1 | 10.9 | 0.03 | 0.03 | Inv. |
| 24 | Replenisher 3 and Starter | 50 shts. | 100 | 98 | 11.1 | 11.3 | 0.03 | 0.03 | Inv. |
| 25 | Replenisher 4 and Starter | 50 shts. | 100 | 100 | 11.1 | 10.9 | 0.03 | 0.03 | Inv. |
| 26 | Replenisher 1 and Starter | 50 shts. | 100 | 100 | 11.1 | 11.0 | 0.03 | 0.03 | Inv. |
| 27 | Starter | 50 shts. | 100 | 103 | 11.1 | 10.8 | 0.03 | 0.04 | Comp |

Comp.: Comparison
Inv.: Invention
In experiment 21, 50 full-sheet of papers were processed while a starter for a developer was replenished in an amount of every 40 ml per a full-sheet of paper (50.8 × 61.0 mm sized light-sensitive material) to get a photographic density of 80%.
In experiments 22 to 25, replenishing-solutions 1 to 4 was added by 800 ml respectively and then, 50 full-sheet of papers were processed while the starter for the developer was replenished in an amount of every 40 ml per the full-sheet of paper to get a photographic density of 80%.
In experiment 26, 20 full-sheet of papers were processed while replenishing solution 1 was replenished in an amount of every 40 ml per full-sheet of paper to get a photographic density of 80%, and then, 30 full-sheet of papers were processed while the starter for a developer was replenished in an amount of every 75 ml& per the full-sheet of paper to get a photographic density of 80%.
In experiment 27, 50 full-sheet of papers were processed while the starter for a developer was replenished in an amount of every 75 ml per a full-sheet of paper to get a photographic density of 80%.

As is obvious from the results shown in Table 3, in Experiments 21 and 27, the sensitivity was increased and the fog and the Gamma were seriously deteriorated.

In experiment 27 (comparative sample), to obtain the same improved results as the present invention in Sensitivity, Gamma, Fog and Black spot, a large replenishing amount (90ml) should be employed compared with a replenishing amount (50 ml) of experiments 22 through 26 (inventive samples).

In Experiments 22 through 26 each of the invention, a stable processing could be performed as same as in making use of a fresh solution.

(Advantages of the invention)

According to the invention, a developer replenishing method can be so provided that a low replenishment can be performed in a rapid processing without affecting any characteristics and a developer stability can also be excellent.

What is claimed is:

1. A method for developing an exposed black and white silver halide photographic light-sensitive material with a developer having a pH within the range of 9.5 to 10.7 through an automatic processor, wherein said silver halide photographic light-sensitive material comprises a support and thereon, at least one silver halide emulsion layer comprising silver halide grains containing at least 60 mol % of silver chloride, comprising the steps of:

replenishing said developer with a first developer replenishing solution containing a developing agent and having a lower activity than a starting developer solution, and replenishing said developer with a second developer replenishing solution containing said agent and having an activity substantially equivalent to the activity of said starting developer solution.

2. The method of claim 1, wherein said activity of said first developer replenishing-solution is less than 95% of that of said starting developer.

3. The method of claim 1 wherein said first developer replenishing solution is replenished in a predetermined amount, sufficient to adjust the activity to the level of said starting developer, and then, said second developer replenishing solution is replenished in a predetermined amount per a specific unit area of said silver halide photographic material.

4. The method of claim 3, wherein said first developer replenishing-solution is replenished in a predetermined amount, and then, said second developer replenishing-solution is replenished in an amount of 75 to 200 ml per 1 $m^2$ of said silver halide photographic material.

5. The method of claim 1, wherein a hydrazine derivative is contained in at least one layer of said silver halide emulsion layer and an adjacent layer of said silver halide emulsion layer.

6. The method of claim 1, wherein a tetrazolium derivative represented by Formula T, is contained in at least one layer of said silver halide emulsion layer and an adjacent layer of said silver halide emulsion layer:

Formula T

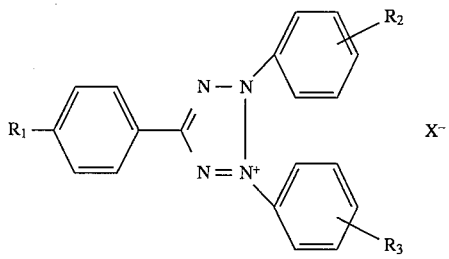

wherein $R_1$, $R_2$ and $R_3$ each represents a hydrogen atom, an alkyl group, an amino group, an acylamino group, a hydroxyl group, an alkoxy group, an acyloxy group, a halogen atom, a carbamoyl group, an acylthio group, an alkoxycarbonyl group, a carboxyl group, an acyl group, a cyano group, a nitro group, a mercapto group, a sulfoxy group or an aminosulfoxy group; $X^-$ represents a halide ion, an acid radical of an inorganic acid, an alkyl benzene sulfonic acid anion, an alkyl sulfate anion, a boric anion, dialkyl sulfosuccinate anion, a polyether alcohol sulfate anion, an aliphatic anion, or an acid radical of polyacrylic acid.

7. The method of claim 1, wherein an amount of said developing agent in said first replenishing-solution, is within the range of 70% to 98% of said developing agent in said starting developer solution.

8. The method of claim 1 wherein a pH value of said first developer replenishing solution is 0.1 to 0.5 lower than a pH value of said starting developer solution.

9. The method of claim 1, wherein an amount of a development inhibitor in said first developer replenishing-solution, is within the range of 102% to 180% of said development inhibitor in said starter for said developer.

10. The method of claim 1, wherein an amount of water for said first developer replenishing-solution is within the range of 102% to 180% of an amount of water for said starter for developer.

11. The method of claim 1 wherein said first developer replenishing solution comprises said starting developer solution and water, wherein said starting developer solution and said water are replenished at the same time in said step of replenishing of said first developer replenishing solution.

12. The method of claim 1 wherein said first developer replenishing solution comprises said starting developer solution and water, wherein said starting developer solution and said water are replenished independently in replenishing said first developer replenishing solution.

13. The method of claim 1, wherein said first developer replenishing-solution and said second developer replenishing solution each comprises a nonbenzo-condensed ring nitrogen-containing heterocyclic compound having at least one group selected from a mercapto group or a thione group.

14. The method of claim 1, wherein said first developer replenishing-solution and said second developer replenishing-solution each comprises a compound represented by the following Formula I:

Formula I

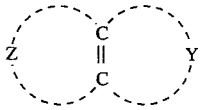

wherein Z and Y each represents a ring capable of forming an unsaturated 5- or 6-membered ring provided that a total number of nitrogen atoms contained in Z and Y, is three or more, that at least one of Z and Y has a mercapto group and a substituent of Z or Y is selected from the group consisting of a halogen atom, a lower alkyl group, a lower alkoxy group, a hydroxy group, a sulfo group, a substituted or unsubstituted allyl group, an amino group, a COOM group in which M represents a hydrogen atom, an alkali-metal atom or an ammonium group, a carbamoyl group and a phenyl group.

15. The method of claim 1, wherein said first developer replenishing-solution and said second developer replenishing-solution each comprises at least one compound of the following Formulas A through F:

Formula A

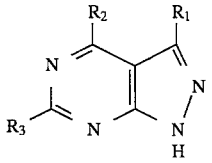

-continued

Formula B

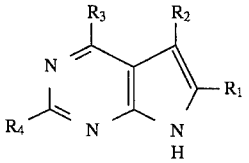

Formula C

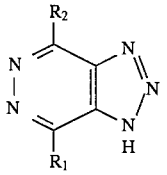

Formula D

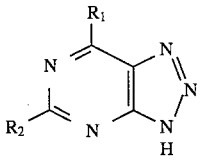

Formula E

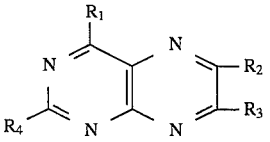

Formula F

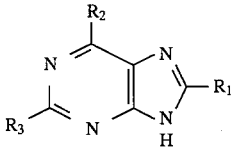

wherein $R_1$, $R_2$, $R_3$ and $R_4$ represents a hydrogen atom, a halogen atom, a lower alkyl group, a substituted or unsubstituted amino group, a —$COOM_1$ group, a substituted or unsubstituted carbamoyl group or a substituted or unsubstituted phenyl group, provided that at least one of $R_1$, $R_2$, $R_3$ and $R_4$ represents an $SM_2$ group; and $M_1$ and $M_2$ represent each a hydrogen atom, an alkali-metal atom or an ammonium group.

16. The method of claim 1, wherein a hydrazine derivative represented by Formula H, and a nucleation-accelerating agent represented by Formula Na, are each contained in at least one layer selected from said silver halide emulsion layer or an adjacent layer of said silver halide emulsion layer:

Formula H

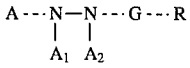

wherein A represents an aryl group or a heterocyclic group having at least one sulfur or oxygen atom; G represents a

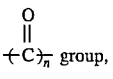

a sulfonyl group, a sulfoxy group,

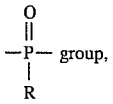

or an iminomethylene group; n is an integer of 1 or 2; $A_1$ and $A_2$ each represents a hydrogen atom or one of them represents a hydrogen atom and the other represents a substituted or unsubstituted alkylsulfonyl group; and R represents a hydrogen atom, an alkyl group, an aryl group, an alkoxy group, an aryloxy group, an amino group, a carbamoyl group, an oxycarbonyl group or an —O—$R_2$ group in which $R_2$ represents an alkyl group or a saturated heterocyclic group:

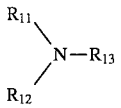

Formula Na wherein $R_{11}$, $R_{12}$ and $R_{13}$ each represents a hydrogen atom, a substituted or unsubstituted alkyl group, a substituted or unsubstituted alkenyl group, a substituted or unsubstituted alkinyl group, a substituted or unsubstituted aryl group, and a ring can be formed of $R_{11}$, $R_{12}$ and $R_{13}$, provided that all of $R_{11}$, $R_{12}$ and $R_{13}$ are not hydrogen atoms.

17. The method of claim 16, wherein said nucleation-accelerating agent represented by Formula Na, contains a diffusion-resistive group in the molecule.

18. The method of claim 16, wherein said nucleation-accelerating agent represented by Formula Na, contains a silver halide adsorption group in the molecule.

19. The method of claim 18, wherein said silver halide adsorption group in the molecule is a thioether group.

* * * * *